United States Patent [19]

Weber

[11] 4,091,883

[45] May 30, 1978

[54] UNDERREAMING TOOL WITH OVERRIDING EXTENDED ARM RETAINER

[75] Inventor: Robert W. Weber, Long Beach, Calif.

[73] Assignee: The Servco Company, a division of Smith International, Gardena, Calif.

[21] Appl. No.: 668,577

[22] Filed: Mar. 19, 1976

[51] Int. Cl.[2] ..... E21B 9/30

[52] U.S. Cl. ..... 175/287; 175/290; 175/322

[58] Field of Search ..... 175/286, 287, 284, 290, 175/321, 322, 275, 279; 166/216, 217

[56] References Cited

U.S. PATENT DOCUMENTS

| | | | |
|---|---|---|---|
| 2,809,016 | 10/1957 | Kammerer, Jr. | 175/287 X |
| 3,749,187 | 7/1973 | Leathers | 175/287 X |
| 3,817,339 | 6/1974 | Furse | 175/286 X |

*Primary Examiner*—Ernest R. Purser
*Assistant Examiner*—William F. Pate, III
*Attorney, Agent, or Firm*—Christie, Parker & Hale

[57] ABSTRACT

An underreamer includes a mounting member and a plurality of cutter arms. Means pivotally mounts the cutter arms on the mounting member. Overridable means is operable for holding the cutter arms relatively outward in an underreaming position. The overriding means is operable to allow the cutter arms to move relatively inward upon forces on the cutter arms above a predetermined level.

18 Claims, 5 Drawing Figures

68
14
20b
g3
g1
k3
K1
20
20a
g2
K2
k1
G3
G1
k2
G2
38
38
46
46
42
36
16
10
22
16
31
32
30
31
29
50
50
52
60
58
60
58
52
55
71
64
56
64
55
62
70
56
24
26
76
72
76
28
74
28
28

13
14
g3
20
g4
g2
20b
K3
k3
K1
20a
K2
k2
k4
G3
G1
40
G2
46
46
36
42
16
10
16
30
22
32
32
54
50
50
71
26
55
55
24
28
28
12

UNDERREAMING TOOL WITH OVERRIDING EXTENDED ARM RETAINER

BACKGROUND

This invention relates to underreaming and chambering tools and more particularly to mechanisms in such tools for controlling the position of cutter arms.

Rotary drills are commonly used for earth boring operations. Such drills are employed in oil and gas wells as well as in mining operations. Often it is desirable to enlarge the diameter of a hole drilled in a downward direction starting at some point a substantial distance below the surface. In oil and gas wells this is commonly referred to as underreaming, whereas in mining it is commonly referred to as chambering. For ease of explanation, both operations are generally referred to herein as underreaming.

To effect underreaming operations a variety of underreamers, hole openers, and the like have been devised. With some devices the underreamer can only be installed on the drill string when underreaming operations are taking place. This requires removal of the drill string each time a change is made from straight drilling to underreaming of vice versa.

Other devices employ various controllable cutter actuators to move underreaming cutters into or out of underreaming position while a drill is connected below the underreamer for drilling purposes. Some such devices use fluid pressure, for example, due to recirculating drilling mud or the like to actuate a cutter into an extended cutting or underreaming position. In other known underreaming devices, mechanical adjustment of the drill string connected to the underreamer and fluid or pneumatic pressure applied through the drill string is used to move cutters to an underreaming position. One such device is disclosed in U.S. Pat. No. 3,817,339. In other devices purely mechanical control is employed.

Generally, presently known underreamers retract the cutter arms from an extended underreaming position to a retracted clearance position prior to the time that the underreamer is removed from the hole. If the underreaming arms do not retract before the underreamer is lifted from the hole, it is because there is a malfunction, or the arms have been wedged open by dirt or debris or other matter collecting under the cutter arms.

Particularly in mining operations, it has been found that following an underreaming operation, soil and rock debris tend to stick on the sides of the hole, thereby partially filling up the underreamed portion. This is undesirable and therefore it is desirable to remove the buildup of debris from the walls of the underreamed portion of the hole.

BRIEF SUMMARY OF THE INVENTION

Briefly, an embodiment of the present invention involves an underreamer which has a mounting member and a plurality of cutter arms. Means is provided for pivotally mounting the cutter arms on the mounting member. An overridable means is operable for holding the cutter arms relatively outward in the underreaming position. The overriding means is operable to allow the cutter arms to move relatively inward when subjected to forces on the cutter arms above a predetermined level. With the foregoing arrangement, an operator may extend the cutter arms to the underreaming position and then underream, or underream and drill, downward.

After the underreaming operation is complete, the drill string and the attached underreamer can be removed from the hole, leaving the arms extended and under control of the overridable means. As the underreamer is moved upwardly and simultaneously rotated, the extended arms will knock off the soil which has become stuck on the inside wall of the underreamed area of the hole. When the arms reach the upper end of the underreamed area where the hole is of smaller diameter, the shoulder of the smaller diameter hole will apply the predetermined force to the arms, causing them to retract to the clearance position.

Preferably the overridable means comprises a yieldable means for acting on the cutter arms to hold them in the underreaming position.

According to a preferred embodiment of the invention the yieldable means comprises a resilient detent means engaging each of the cutter arms.

In a still further preferred embodiment of the invention the detent means comprises a recess and a resiliently biased member engaging the recess.

According to a still further preferred embodiment of the invention, one of such recesses is carried on each of the cutter arms and one of such resilient biased members is carried on each of the cutter arms and engages the recess on the other arm.

Preferably the resilient biased member comprises a ball, means for mounting the ball in the respective cutter arm for movement toward and away from the adjacent arm, and resilient means for urging the ball in a direction towards the adjacent arm.

In a still further preferred embodiment of the invention the underreamer is of the type that has telescoping upper and lower portions connectable respectively to an upper drill string and a lower drill string. The cutter arms are pivotally mounted on one of the upper and lower telescoping portions.

According to a still further preferred embodiment of the invention involving the telescoping upper and lower portions, means is responsive at least in part to relative positions of the upper and lower portions, for positioning and locking the cutter arms in a relatively extended underreaming position or in a relatively inward clearance position, and for unlocking the cutter arms in the underreaming position. When the unlocked position occurs, the overridable means is effective for holding the cutter arms in the underreaming position in the manner described hereinabove.

A subcombination of the present invention is an underreamer cutter arm comprising an elongated body, a transverse pivot pin hole through the body, and a journal on one end of the body for mounting a cutter cone for rotation about an axis which is transverse to the axis of the pivot pin hole. A camming surface is provided on the other end of the body from the journal for pivoting the body about the axis of the pivot pin hole. The cam and the journal face in the same rotational sense relative to the axis of the pivot pin hole.

A first portion of a detent is positioned along an edge of the elongated body and a second portion, forming the rest of a detent, is positioned on an opposite edge of the elongated body from the first portion.

These and other features and advantages of the present invention will be appreciated as the same become better understood by reference to the following detailed description of the presently preferred embodiment when considered in connection with the accompanying drawings wherein:

DRAWINGS

DESCRIPTION

Figure 1:
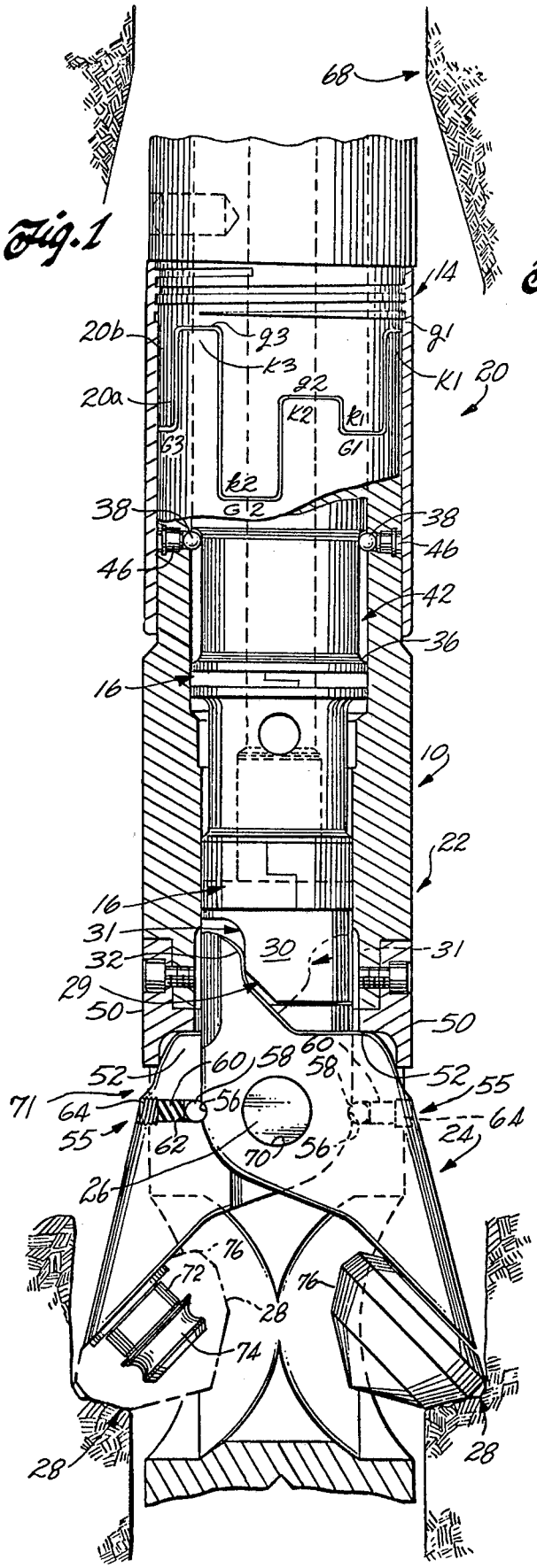
FIG. 1 is a longitudinal cross-section of the lower underreamer portion with the cutter arms extended and embodies the present invention.
Figure 2:
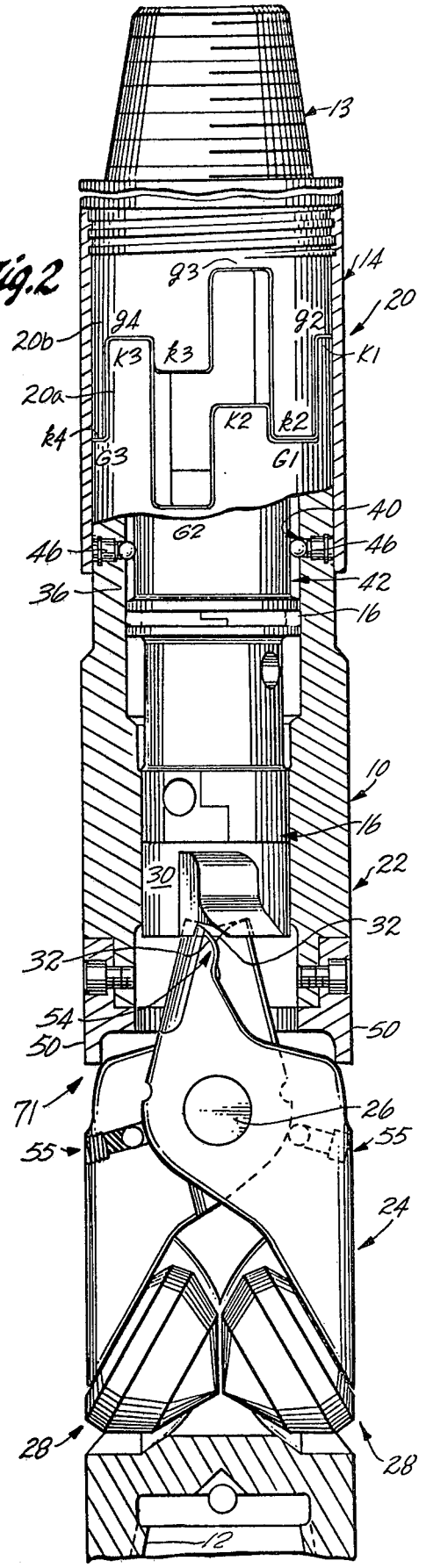
FIG. 2 is a longitudinal cross-section similar to FIG. 1 with the cutter arms retracted.

FIGS. 1 and 2 illustrate in side view and partially in section a combined underreamer and latching selector sub constructed according to the principles of the present invention. As illustrated in the present and preferred embodiment, the underreamer has a lower generally tubular shaped outer body portion 10 which may be connected to a lower portion of a drilling string by a conventional threaded female joint 12. The lower portion of the drill string (not shown) typically includes a conventional drill for forming a hole or bore in the earth as the drill string is rotated. Such drills are conventional, forming no part of the present invention, and are not further described herein. The drill is usually coupled directly to the underreamer. Also provided is an upper generally tubular shaped inner body portion 14. The upper body portion contains a threaded male joint 13 for connecting to the lower portion of an upper drill string (not shown). The upper and lower body portions 10 and 14 form longitudinally telescoping upper and lower body portions as they move relative to each other in a longitudinal direction.

The lower portion of the upper body portion 14 slides along the interior wall of the tubular shaped lower body portion 10. Low friction ring and seal bearing 16 are spaced apart longitudinally in grooves formed around the circumference of the lower portion of the upper body portion 14. Although the invention is not limited thereto, NYLATRON (a registered trademark) GS type bearings made by the Polymer Corporation are used. Significantly the ring and seal bearings 16 form virtually frictionless bearing surfaces on the interior wall of the lower body portion 10. This is quite important as it allows the upper telescoping portion 14 to be easily rotated relative to the lower portion 10 while the portion 10 is only held by friction in a hole being bored.

A splined connector 20 with two separable circular portions is provided in between the telescoping upper and lower body portions 14 and 10 at the tubular shaped portions thereof. Significantly, the splined connector 20 has a first and a second engaged position. Each position has a different angular and a different longitudinal engaged position for the splined connector and hence the upper and lower telescoping portions 14 and 10.

The splined connector 20 has identical lower and upper portions 20*a* and 20*b*, respectively. The lower splined connector portion 20*a* includes longitudinally facing and staggered grooves G1,G2 . . . G6 and longitudinally facing and staggered keys K1,K2 . . . K6 in the lower body portion 10. Mating with the notches and grooves in the lower body portion are longitudinally facing and staggered grooves *g*1,*g*2,*g*3 . . . *g*6, and longitudinally facing and staggered keys *k*1,*K*2, . . . *K*6 in the upper body portion 20*b*. The keys and grooves are arranged into three 120° sections. The keys and grooves in one section are identical with those in each of the other sections. Each key and groove is 30° in width, although the invention is not limited thereto. Note with respect to FIG. 1 that keys *k*1,*k*2 . . . *K*6 extend into and engage the grooves G1,G2 . . . G6 whereas the keys K1,K2 . . . K6 extend into and engage the grooves *g*1,*g*2 . . . *g*6. Not all keys and grooves can be seen in FIGS. 1 and 2. By longitudinally lifting the upper portion 14 (upward as depicted in FIG. 2) with respect to the lower portion 10 and rotating it clockwise 60° as viewed from the top and then allowing the upper portion 14 to move downwardly in the direction of the lower portion 10, different notches and keys become engaged. For example, in FIG. 2 the keys K1,K3 not extend into grooves *g*2,*g*4. Similarly, keys *k*2,*k*4 now extend into and engage the grooves G1,G3. With such an arrangement the upper portion 14 is held in a different angular and longitudinal position with respect to the lower body portion 10 in FIG. 1 as compared with FIG. 2.

Thus the keys and grooves K1,G1,K2,G2 form one 120° angular section of the splined connector on the lower portion 10. Similarly, grooves and keys *g*1,*k*1,*g*2,*k*2 form one 120° angular section of the portion of the splined connector on the upper portion 14. Two additional 120° angular sections of the splined connector are provided on the upper and lower telescoping portions 14 and 10 extending around the underreamer.

Figure 2A:
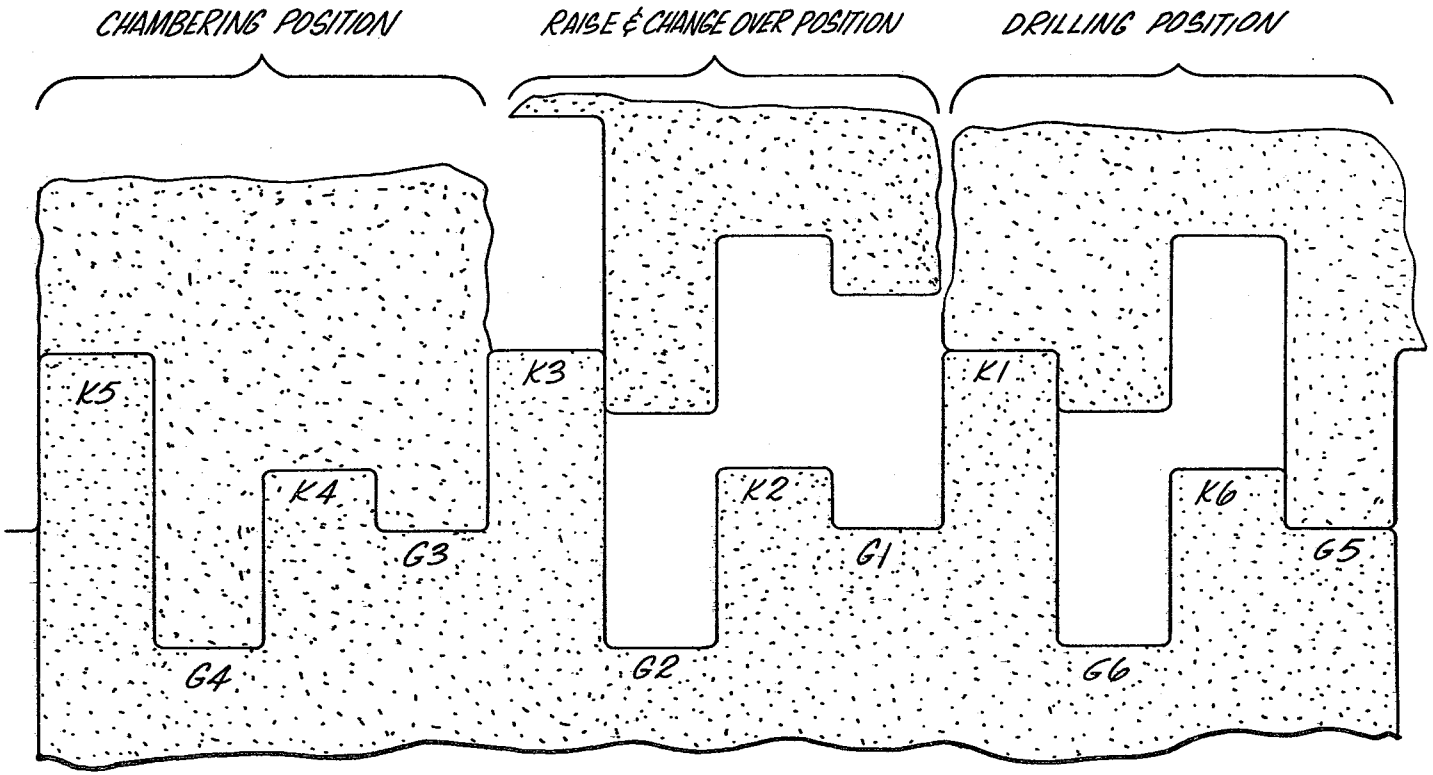
FIG. 2A is a flat pattern view depicting the three positions of the connector portions making up the splined connector.

FIG. 2A shows a flat pattern view of the circumference of the lower connector portion 20*a* with its keys and grooves. An example of one segment of the upper portion 20*b* of the connector 20 is shown above the lower connector portion 20*a* depicting the three positions of the splined connector 20. From left to right the connector portions are in the CHAMBERING position, the changeover position and the DRILLING position.

A pair of cutter arms 24 are pivotally mounted on the lower body portion 10 by means of a pivot 26. The arms are pivotally mounted in a slot 71 which extends through the lower portion 10 from side to side transverse to the longitudinal axis of the underreamer. Only one half of the slot is seen in FIGS. 1 and 2, the other half being essentially a mirror image of the half shown.

Rock crushing cutters 28 of the conventional sort, and illustrated schematically, are rotatably mounted on the lower ends of the two cutter arms 24. On the lower end 22 of the upper portion 14 is a cam 30. A cam follower 32 is provided on each of the arms at the opposite end of the arms from the cutters 28. The cam follower 32 end of the arms 24 is about one-half the width of the center portion of the arms and the two arms are mounted on the pivot in a scissor fashion.

Also provided is a stop for limiting the extent of longitudinal movement between the upper and lower portions 14 and 10. The stop includes an elongated outwardly facing ring shaped groove 42 on the outer wall of the upper portion 14. The groove 42 has a stop portion 36 at the lower end of the groove 42 which, to be explained in more detail, engages balls to stop movement between the telescoping portions before the splined connector is moved longitudinally apart to a non-engageable position.

Also included in the stop is an inwardly facing ring shaped groove 40 adjacent to the outwardly facing groove 42 and positioned in the inner wall of the lower portion 10. Also included are a plurality of balls 38 which are retained in both of the grooves 40 and 42. In operation, the balls 38 engage the stop portion 36 of the groove 42 to stop the longitudinal movement between the upper and lower portions 14 and 10 at the extremity of their movement apart.

Three plugs 46 (only two being shown) are positioned into each of a plurality of openings drilled along different radii around the periphery of the lower portion 10 and adjacent to the groove 40. The openings are large enough for the balls 38 to be inserted therethrough and in between the grooves 40 and 42. The balls are positioned through these openings into the grooves and then each plug 46 is positioned in place, and locked by a "C" shaped retaining ring, to keep the balls 38 from sliding out of the grooves.

A tubular shaped sleeve 14*a* is threaded onto the upper portion 14. The sleeve 14*a* extends over the splined connector even when the upper portion 14 has been raised to its full extended position with the balls 38 in engagement with the stop portion 36. The sleeve 14*a* also extends over the plugs 46 when the splined connector 20 is in the underreaming position or the drilling position depicted in FIGS. 1 and 2, respectively. As a result, the plugs as well as the splined connector are protected from dirt and other debris encountered in drilling operations. However, the sleeve 14*a* will expose the plugs 46 when the upper and lower telescoping portions and hence the splined connector portions 20 are raised to the changeover position, thereby allowing access to the plugs 46 for assembly, disassembly or repair.

Two stop lugs 50 are bolted onto the lower portion 10 adjacent to the arms 24. Stop lugs 50 are inactive when the cutter arms are in their retracted position depicted in FIG. 2. When the cutter arms are extended as depicted in FIG. 1, a shoulder 52 on each of the arms 24 engages the respective stop lug and limits the outward movement of the cutter arms to a preselected extended position. Engagement of the shoulders with the stop lugs determines the size of the underreaming portion of the hole.

Figure 3:
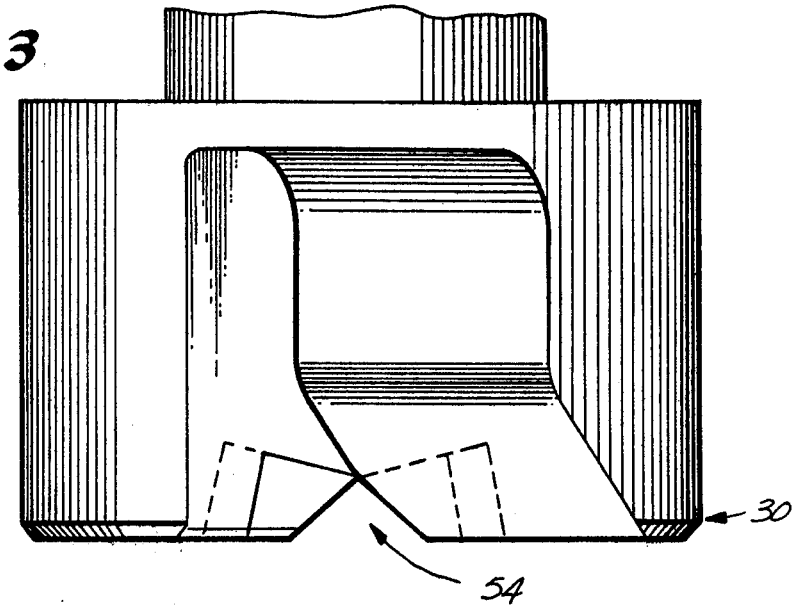
FIG. 3 is a side elevation view of the cam shown in FIGS. 1 and 2.
Figure 4:
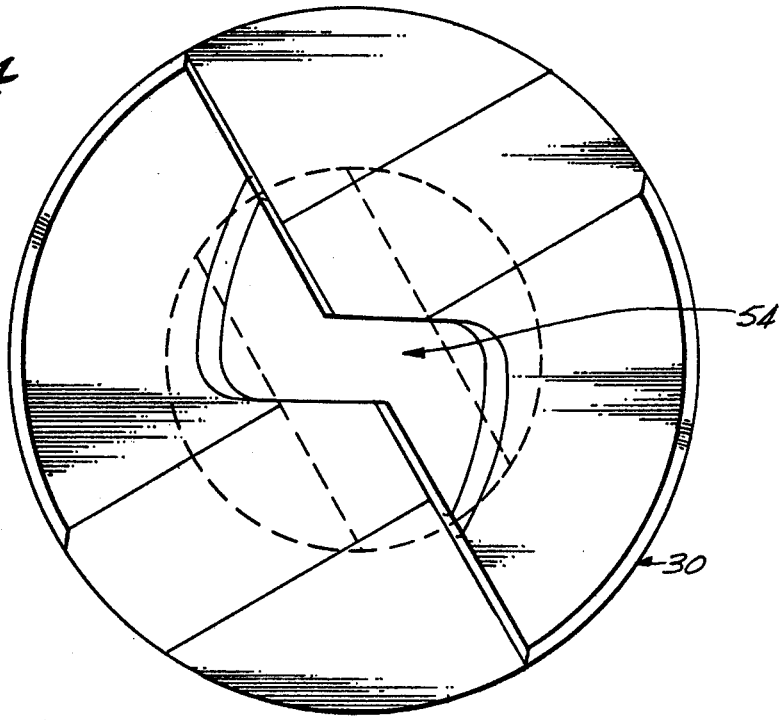
FIG. 4 is a bottom view of the cam shown in FIG. 3.

The cam 30 has a slot 54 into which the cam follower 32 ends of the arms 24 extend. The slot 54 is best seen in FIGS. 2, 3 and 4 and is dimensioned so as to engage the cam followers 32 and hold the arms to their clearance position depicted to FIG. 2 when the splined connector is in the position depicted in FIG. 1.

By providing the slot 54 at the end of the cam for engaging the cam followers, the cutter arms are held in their clearance position even when subjected to centrifugal force thereby preventing their inadvertent movement outwardly which may occur when the drill string is being rotated at a high speed.

Consider briefly the operation of the underreamer. An upper drill string is connected at the male threaded joint or connector 13 and a lower drill string is connected at the female threaded joint or connector 12. Assume that the underreamer is positioned in the condition depicted in FIG. 2. In this position the slot 54 in the cam 30 of the upper portion 14 holds the cutter arms 24 in the retracted clearance position. This is true even if the tool is rotated at high speed, subjecting the cutter arms to outward forces.

Should it be desired to extend the cutter arms 24 to simultaneously underream and drill, the upper drill string is raised from the drilling position of the splined connector 20 shown in FIG. 2 to the changeover position where the two portions of the splined connector 20 disengage, and then the upper drill string and hence the upper body portion 14 are rotated clockwise as viewed from the top until the side walls of keys *k*2 and K3 strike. This will rotate the cam 30 to the position indicated in FIG. 1. The drill string and hence the upper portion 14 are then lowered to the chambering position of the splined connector 20 while the lower portion 10 is held in the hole until the cam surfaces 29 on the cam 30 act against the cam followers 32 and move the cutter arms 24 to the extended position shown in FIG. 1. The weight of the drill string will cause this action. The upper portion of the camming surfaces 29 form a lock 31 to lock the cutter arms in the extended position depicted in FIG. 1.

When the cutter arms are in either the clearance position of FIG. 2 or the extended position of FIG. 1, the splined connector 20 provides a series of substantially longitudinally extending side walls which provide torque transmission between the upper and lower portions 14 and 10 during drilling and/or underreaming operations. During underreaming operations when the connector 20 is in the chambering position, as depicted in FIG. 1, the adjacent side walls of the two connector portions 20*a* and 20*b* abut fully along their entire length, giving maximum torque transmission.

When it is desired to retract the cutter arms 24 from the extended to the clearance position, the upper drill string is again lifted upward, moving the upper portion 14 upward with respect to the lower portion 10 until the grooves and keys, which are engaged in FIG. 1, are disengaged. The cutter arms 24 will rotate back to the clearance position of FIG. 2, normally under their own weight. The upper drill string is then rotated counterclockwise as viewed from the top and then the drill string and upper portion 14 are allowed to move downward under their own weight until the splined connector 20 is engaged as depicted in FIG. 2, thereby holding the outer portion 14 in an upward position with respect to the position depicted in FIG. 1. In the process the slot 54 passes over the ends of the cam followers 32 and automatically locks the arms in the retracted clearance position of FIG. 2.

The splined connector is disclosed and claimed in co-pending U.S. patent application Ser. No. 668,412 filed Mar. 19, 1976, entitled UNDERREAMER HAVING SPLINED TORQUE TRANSMITTING CONNECTOR BETWEEN TELESCOPING PORTIONS FOR CONTROL OF CUTTER POSITION, filed in the name of the same inventor as the present application.

Significant to the present invention there is provided an overridable means which is operable for holding the cutter arms relatively outward in the underreaming position. The overriding means is overridable to allow the cutter arms to move relatively inward upon forces on the cutter arms above a predetermined level.

Referring specifically to FIGS. 1 and 2, the overridable means is in the form of a detent 55, one on each side of the pivot 26. Considering the detent 55 on the left, a detent portion in the form of a recess 56 is positioned in the edge of the right hand arm and faces away from the axis of the underreamer. The other detent part of the same detent is in the left hand arm and includes a ball 58 and a cylindrical shaped resilient member 60 positioned in a circular shaped opening 62. After mounting the arms as depicted in FIG. 1, the ball 58 is positioned in the passage 62. The resilient member 60 is positioned immediately behind the ball and a plug 64 is threaded into the opening 62, placing the resilient member 60 in compression and resiliently biasing the ball 58 into the recess 56.

The detent 55 on the right side of the pivot 26 is identical to that on the left except the detent parts are reversed on the two arms. With this arrangement the detents are positioned with one part in one arm and the other part in the other arm. Further, it will be noted that the balls and recesses are aligned along a substantially straight line extending through the center of the pivot 26. With this arrangement the loading on the arms created by the detents acts directly through the center of the pivot 26.

With the foregoing arrangement, assume that an underreaming operation has taken place, causing an underreamed portion in the bottom of a hole as depicted in FIG. 1. A shoulder 68 is formed where the underreamed portion meets the smaller diameter hole extending upwards. Assume now that the operator removes the underreamer from the hole. The operator simply lifts upwardly on the drill string, causing the splined connector parts to separate until the ball 38 engages the stop portion 36. When this occurs the cam lock 31 is disengaged from the cam followers 32, thereby unlocking the cutter arms 24. However, the arms 24 do not act under their own weight to rotate back to the clearance position shown in FIG. 2 because the detents 55 hold the cutter arms in their outward underreaming position depicted in FIG. 1. As the drill string and hence the underreamer are lifted upwardly in the hole and rotated, the cutters 28 will remove any debris struck onto the sides of the hole, cleaning out the underreamed portion until the shoulder 68 is reached. When the shoulder 68 is reached, a force is applied to the cutter arms 24 in an upward direction and, when a sufficient force exceeding that required to overcome the detents is exerted, the arms 24 will collapse or rotate inwardly to the clearance position depicted in FIG. 2.

In accordance with a preferred embodiment of the present invention, each cutter arm 24 is elongated and has a transverse pivot hole 70 for a pivot pin.

Each of the cutter arms carries a ball bearing race 74 on a cutter journal 72 depicted in dashed line. The cutter cone 76, shown in full on the right and in broken line on the left in FIG. 1, is mounted on the journal with its axis of rotation transverse to the pivot pin 26 axis, and ball bearings (not shown) are positioned in the bearing race 74 to provide rotational support and lock the cutter cone on the journal. A ball retainer (not shown) retains the ball bearings in the race. The mounting of the cutter cone on a journal is conventional.

It will be noted that the camming surfaces of the cam followers 32 are on the other end of the body of the arms from the journal. The cam surface and the journal face in the same rotational sense relative to the axis of the pivot pin 26.

Preferably, the detents extend between the arms as depicted in the Figures because of simplicity of design and superior operational characteristics.

Although an exemplary embodiment of the invention has been disclosed for purposes of illustration, it will be understood that various changes, modifications and substitutions may be incorporated into such embodiment without departing from the spirit of the invention as defined by the claims appearing hereinafter.

What is claimed is:

1. An underreamer comprising:

a mounting member having a longitudinal axis;

a plurality of cutter arms;

means for pivotally mounting said cutter arms on said mounting member for lateral movement of the cutter arms between an inward position close to such axis and an outward underreaming position away from such axis; and overridable means, separate from the means for pivotally mounting, operable for holding said cutter arms in said outward underreaming position, said overridable means being responsive to forces exceeding a predetermined level and applied in a lateral direction between the cutter arms to release and allow said cutter arms to move to said inward position.

2. An underreamer according to claim 1 wherein said overridable means comprises yieldable means for acting on said cutter arms to hold same in the outward underreaming position.

3. An underreamer according to claim 2 wherein said yieldable means comprises resilient detent means extending between said cutter arms.

4. An underreamer according to claim 2 wherein said detent means comprises at least two detent means, each said detent means comprising a recess and a resiliently biased member engaging the corresponding one of said recesses.

5. An underreamer comprising:

a mounting member;

a plurality of cutter arms;

means for pivotally mounting said cutter arms on said mounting member for movement between an inward position and an outward underreaming position; and overridable means operable for holding said cutter arms in said outward underreaming position and operable to allow said cutter arms to move to said inward position responsive to a force on said cutter arms in said inward direction, said overridable means comprising at least two detent means, each said detent means comprising a recess and a resiliently biased member engaging the corresponding one of said recesses, a different one of said recesses being located on each of said cutter arms and a different one of said resiliently biased members being located on each of said cutter arms.

6. An underreamer according to claim 5 wherein said resiliently biased member comprises a ball, means for mounting said ball in the respective cutter arm for movement toward and away from the adjacent arm, and resilient means for urging said ball in a direction toward the adjacent arm.

7. An underreamer comprising:

longitudinally telescoping upper and lower portions connectable respectively to an upper drill string and a lower drill string;

a splined connector between said telescoping portions having first and second engaged positions and a third position, the first and second positions each for transmitting torque between the telescoping portions, said splined connector providing a different angular and a different longitudinal position for the telescoping portions in each of said first and second positions, said third position providing a still further longitudinal position for the telescoping portions;

a plurality of cutter arms;

means for pivotally mounting said cutter arms on one of said telescoping portions;

means on the other telescoping portion for urging said cutter arms relatively outward towards an extended underreaming position when said splined connector is in said first position and for holding said cutter arms retracted relatively inwardly to a clearance position when said splined connector is in said second position; and overridable means operable for holding said cutter arms in said underreaming position when said splined connector is in said third position, said overridable means being overridable to allow said cutter arms to move relatively inwardly responsive to forces on said cutter arms exceeding a predetermined level.

8. An underreamer comprising:

telescoping upper and lower portions telescoping in a longitudinal direction and connectable respectively to an upper drill string and a lower drill string;

a plurality of cutter arms;

means for pivotally mounting said cutter arms on one of said telescoping portions;

means responsive at least in part to relative positions of said upper and lower portions for positioning and locking said cutter arms in a relatively extended underreaming position or in a relatively inward clearance position and for unlocking said cutter arms in said underreaming position; and overridable means, separate from the means for pivotally mounting, operable for holding said cutter arms in said underreaming position and being overridable to release and allow said cutter arms to move relatively inwardly responsive to forces exceeding a predetermined level applied laterally between the cutter arms.

9. An underreamer according to claim 8 wherein said overridable means comprises yieldable means for acting on said cutter arms to hold same in the extended underreaming position.

10. An underreamer according to claim 9 wherein said yieldable means comprises resilient detent means extending between said cutter arms.

11. An underreamer according to claim 9 wherein said detent means comprises at least two said detent means, each said detent means comprising a recess and a resiliently biased member engaging the corresponding one of said recesses.

12. An underreamer comprising:

telescoping upper and lower portions telescoping in a longitudinal direction and connectable respectively to an upper drill string and a lower drill string;

a plurality of cutter arms;

means for pivotally mounting said cutter arms on one of said telescoping portions;

means responsive at least in part to relative positions of said upper and lower portions for positioning and locking said cutter arms in a relatively extended underreaming position or in a relatively inward clearance position and for unlocking said cutter arms in said underreaming position; and overridable means operable for holding said cutter arms in said underreaming position and being overridable to release and allow said cutter arms to move relatively inwardly responsive to forces exceeding a predetermined level applied laterally between the cutter arms, said overridable means comprising at least one detent means for each said cutter arm, each said detent means comprising a recess and a resiliently biased member engaging the corresponding one of said recesses, a different one of said recesses being located on each of said cutter arms and a different one of said resiliently biased members being located on each of said cutter arms.

13. An underreamer comprising:

telescoping upper and lower portions telescoping in a longitudinal direction and connectable respectively to an upper drill string and a lower drill string;

at least one cutter arm;

means for pivotally mounting said at least one cutter arm on one of said telescoping portions;

means responsive at least in part to relative positions of said upper and lower portions for positioning and locking said at least one cutter arm in a relatively extended underreaming position or in a relatively inward clearance position and for unlocking said at least one cutter arm in said underreaming position; and overridable means, separate from the means for pivotally mounting, operable for holding said at least one cutter arm in said underreaming position and being overridable to release and allow said at least one cutter arm to move relatively inwardly responsive to a force exceeding a predetermined level applied laterally between said one of said telescoping portions and said at least one cutter arm.

14. An underreamer comprising: longitudinally telescoping upper and lower portions connectable respectively to an upper drill string and a lower drill string;

a plurality of cutter arms;

means for pivotally mounting said cutter arms on one of said telescoping portions;

means responsive at least in part to positions of said upper and lower portions for positioning and locking said cutter arms in a relatively extended underreaming position or for allowing movement of said cutter arms relatively inward to a clearance position; and at least one overridable detent means extending between said cutter arms for holding said cutter arms in said underreaming position, said detent means comprising a first detent part on one of said cutter arms and a second detent part on the other cutter arm.

15. An underreamer cutter arm comprising:

an elongated body;

a transverse pivot pin hole through the body;

journal means on one end of the body for mounting a cutter cone for rotation about an axis transverse to the axis of the pivot pin hole;

camming surface means on the other end of the body from the journal means for pivoting the body about the axis of the pivot pin hole, the camming surface and the journal means facing in the same rotational sense relative to the axis of the pivot pin hole;

a first detent portion of a first detent means along an edge of the elongated body; and a second detent portion of a second detent means on an opposite edge of the elongated body from the first detent portion.

16. An underreamer according to claim 15 wherein said first detent portion comprises a recess and the second detent portion comprises a resiliently biased protrusion.

17. An underreamer according to claim 16 wherein said resiliently biased protrusion comprises a ball at least partially extending from said elongated body, a resilient means for biasing said ball, and an opening in said elongated body for mounting said ball and resilient means.

18. An underreamer according to claim 17 wherein said ball and recess are positioned along a substantially straight line through the center of said pivot pin hole.

* * * * *